US008998531B2

(12) United States Patent
Hanson et al.

(10) Patent No.: US 8,998,531 B2
(45) Date of Patent: Apr. 7, 2015

(54) AUTO PITCH CONTROL POWER TROWEL

(71) Applicants: Steven K. Hanson, Boise, ID (US); Brian L. Hammond, Boise, ID (US); David Lillanthal, Eugene, OR (US); Benjamin A. Wiese, Boise, ID (US); Bruce R. Gillespie, Vancouver, WA (US); Robert Dane Davis, Boise, ID (US); Cole R. Baird, Boise, ID (US)

(72) Inventors: Steven K. Hanson, Boise, ID (US); Brian L. Hammond, Boise, ID (US); David Lillanthal, Eugene, OR (US); Benjamin A. Wiese, Boise, ID (US); Bruce R. Gillespie, Vancouver, WA (US); Robert Dane Davis, Boise, ID (US); Cole R. Baird, Boise, ID (US)

(73) Assignee: Multiquip, Inc., Carson, CA (US)

( * ) Notice: Subject to any disclaimer, the term of this patent is extended or adjusted under 35 U.S.C. 154(b) by 0 days.

(21) Appl. No.: 13/676,870

(22) Filed: Nov. 14, 2012

(65) Prior Publication Data

US 2013/0129419 A1 May 23, 2013

Related U.S. Application Data

(60) Provisional application No. 61/561,597, filed on Nov. 18, 2011.

(51) Int. Cl.

| | |
|---|---|
| ***E01C 19/22*** | (2006.01) |
| ***E01C 19/42*** | (2006.01) |
| ***E04F 21/24*** | (2006.01) |

(52) U.S. Cl.
CPC ..... *E01C 19/42* (2013.01); *E04F 21/247* (2013.01)

(58) Field of Classification Search
CPC ..... E04F 21/24
USPC ..... 404/112
See application file for complete search history.

(56) References Cited

U.S. PATENT DOCUMENTS

| | | | | |
|---|---|---|---|---|
| 8,132,984 | B2 * | 3/2012 | Grahl | 404/112 |
| 8,317,477 | B2 * | 11/2012 | Julius | 416/120 |
| 2010/0150653 | A1 * | 6/2010 | Jaszkowiak | 404/112 |
| 2010/0196162 | A1 * | 8/2010 | Julius | 416/159 |
| 2011/0164923 | A1 * | 7/2011 | Quenzi et al. | 404/118 |
| 2012/0253996 | A1 * | 10/2012 | Bernardy et al. | 705/28 |
| 2013/0315667 | A1 * | 11/2013 | Hanson et al. | 404/112 |

* cited by examiner

*Primary Examiner* — Thomas B Will
*Assistant Examiner* — Katherine Chu
(74) *Attorney, Agent, or Firm* — Frank J. Dykas; Dykas & Shaver

(57) ABSTRACT

An automatic pitch control system for riding power trowels enables a user to control and automatically adjust trowel blade pitch and height for concrete finishing. The disclosed system provides for blade pitch of separate rotor assemblies to be adjusted independently of one another or synchronously. The disclosed system also provides for a mode of operation that allows the user to completely flatten trowel blades for panning.

18 Claims, 7 Drawing Sheets

Forward

Reverse

Swing Right

Swing Left

Crabbing To Right

Crabbing To Left

AUTO PITCH CONTROL POWER TROWEL

PRIORITY/CROSS-REFERENCE TO RELATED APPLICATIONS

This application claims the benefit of U.S. Provisional Application No. 61/561,597, filed Nov. 18, 2011, the disclosure of which is incorporated herein by reference

TECHNICAL FIELD

The present disclosure relates to trowel-blade pitch position adjustment for hydraulically steered, riding power trowels.

BACKGROUND

The process of finishing concrete through the concrete curing phases with a self-propelled power trowel is ever changing. Riding power trowels are used for finishing concrete surfaces as the concrete is curing and hardening. A typical riding power trowel is a two-rotor device, with each rotor having a plurality of troweling blades extending out in radial fashion, and usually configured such that the working edge of each blade is in a plane normal to the axis of rotation to provide for smooth and flat finishing of the concrete surface below the riding trowel. There is provided a rigid frame that houses the rotor assemblies, and also an engine, usually a gasoline or diesel engine, which provides the motive power for the rotor assemblies and thus the trowel blades. Atop of the engine and the frame assembly is found an operator's seat and the necessary control systems and levers for operation of the machine. These machines are manufactured in a variety of sizes and weights, with the largest of these machines having not just two, but rather three, rotor and troweling blade assemblies.

For purposes of this prior art section and the entire specification, a two-rotor machine will be used as an example. In two-rotor machines, both rotor assemblies rotate in opposite directions, one to the other. This is shown in FIG. 1.

In FIG. 1, there is shown a two-rotor assembly, wherein each rotor assembly has a gear box, hydraulic drive motor or other means of driving rotation, and troweling blade assemblies that rotate around respective axes of rotation, identified as $A_{RL}$ for the axis of rotation for the left rotor, and $A_{RR}$ as the axis of rotation for the right rotor assembly. Early versions of riding power trowels were mechanically steered. That is, the riding operator manipulated levers that were mechanically connected to the rotors to steer the trowel. But more recent riding trowels utilize hydraulic steering.

The hydraulically controlled steering power trowel is formed of the same basic sub-assemblies, including a rigid frame, engine assembly, operator seat and manual trowel blade pitch control systems, all of which are well known in the art. Also included are left control post and right control post that house, respectively, a left control valve assembly and a right control valve assembly. In a typical device, both the left and right control valve assemblies are proportional pressure output hydraulic valves capable of delivering and maintaining a selectable pressure to a dual-action hydraulic cylinder. U.S. Pat. No. 5,876,740 ('740 patent) discloses a hydraulically controlled steering power trowel, and the '740 patent is incorporated herein by reference. It should be understood that designations "left" and "right," as used here, are arbitrary; and the functions of what are designated in this disclosure as the "left" and "right" may be accomplished, at the designer's preference, by applying the operable principles to any riding trowel regardless of which of the several assemblies is designated "left" or "right."

The left control valve assembly is operably interconnected between the frame of the power trowel and the left rotor assembly, and is used to adjust the tilt of the left rotor assembly either inwardly toward the center line of the frame, or outwardly away from the center line of the frame. The left control valve assembly is a single-action proportional pressure output valve that is operable to maintain a selectable hydraulic pressure within one or the other sides of the left dual-action hydraulic cylinder and is operably connected to the left rotor assembly to provide a tilting, either in or out from the center line movement for the left rotor assembly.

Hydraulic power is provided by a standard hydraulic pump that is operably connected to the trowel engine.

Again, only one rotor assembly, which in this example is the left rotor assembly, is only tiltable in and out from the center line. This is achieved by use of a universal drive assembly that is provided to interconnect the output drive shaft of the engine assembly to the rotor assembly. The universal drive assembly is capable of allowing the tilt motion for the left rotor either in or out relative to the center line of the power trowel.

Likewise, the right rotor assembly is interconnected by means of a dual-action universal assembly to the output drive assembly of the engine, and is therefore tiltable not only in an in-and-out direction relative to the center line, but it is also capable of being tilted either in a forward or aft direction. The right rotor assembly is provided with a right lever tilt post and a right forward and aft tilt post. Attached to the right lever tilt post is a dual action right tilt cylinder that is interconnected between the frame and the right tilt lever. In a similar manner, a second dual-action cylinder, the right forward and aft tilt cylinder, is interconnected to the right forward and aft tilt post and is anchored to the frame. The right control valve assembly is a dual action control system, and is operable to maintain a selectable hydraulic pressure in either side of both the right tilt cylinder and the right forward and aft cylinder, thus controlling not only the tilt of the right rotor assembly, but also its forward and aft movement.

Both left and right control valve assemblies are fitted with joysticks that are configured such that if they are pushed forward, both rotor assemblies will tilt inwardly to move the power trowel forward, and conversely, if tilted backward toward the operator, they will operate to tilt the rotors outwardly to move the machine backward. The guidance system just described was fully disclosed in the Applicant's '740 patent. What the prior art lacks, however, is a means to monitor and automatically control the pitch position of the individual troweling blades. The prior art is also without a means of disengaging the pitch actuators to allow the blades to "float" in a flat position.

SUMMARY OF DISCLOSURE

While operating a power trowel for "power troweling," the trowel operator must constantly change the pitch of the blades on the trowel to get the desired finish results for the concrete. Pitch of the blades, or pitch position, can be described as the angle of the troweling blades from a plane normal to the troweling-blade-assembly axis of rotation. Pitch position can be measured as an angle or a blade height. The common practice when using trowels embodying the prior art is for trowel operators to adjust the pitch position based on the way the concrete looks as the trowel passes over it, or based on the operator's "feel" for how the blades are affecting the concrete. The prior art, utilizing hydraulic cylinders, raise and lower the blades and thus set the pitch position. Disclosed here is a means to monitor and automate pitch position control. This will increase trowel, and trowel operator, effectiveness and efficiency.

While operating a power trowel for panning, a process disclosed here as "power floating," the trowel is operated with float pans attached to the blades. Power floating depresses the large aggregate in the concrete, removes surface imperfections, creates a smooth surface, brings some mortar to the surface of the concrete, and keeps the surface open, thus allowing water and entrapped air to escape. When float pans are installed, i.e., attached to the blades, it is critical that the blades are flat against the pan so they apply pressure evenly to the pan. If float pans are installed, and the blades are not flat, several issues can arise, including: premature float pan wear; warping of the float pan, which causes the float pan to stick to the concrete; uneven pressure applied to the concrete, which can create imperfections the concrete finish, and which, in turn, affects the flatness of a finished concrete floor. But the present disclosure allows a trowel operator to completely flatten the blades. In the present disclosure, when the pitch position control actuators are disengaged, the blades are allowed to sit perfectly flat against the float pan allowing even pressure to be applied to the pan. This disengagement of the pitch actuators is introduced as "panning mode."

In one embodiment and the best mode of the present disclosure, smart hydraulic cylinders have been incorporated in the place of standard cylinders. These smart cylinders do not directly control the cylinder; rather, they monitor the cylinder by sending a signal for the true position of the stroke of the cylinder. This position feedback signal from the smart cylinders is used by a control unit for calculating blade pitch position. The operator controls the pitch position with the pitch control buttons and a pitch mode selection switch.

The operator can control the pitch position with two switches: a "single pitch control switch" and a "twin pitch control switch." The pitch control logic of the control unit provides for multiple operating modes, controlled by a mode selection switch. These modes are disclosed as: "manual pitch" and "synchronous pitch." In manual pitch mode, when the operator manipulates the twin pitch switch (e.g., up or down), the pitch position of both rotors will be changed simultaneously, but non-synchronously; when the operator manipulates the single pitch switch (e.g., up or down), the pitch of the left rotor will be changed, while the pitch position of the right rotor remains constant. In synchronous mode, when the operator manipulates the twin pitch switch (e.g., up or down), the pitch position of the right and left rotors will be changed simultaneously, and when the twin pitch switch is released, the pitch position of the left rotor is synchronized to the pitch position of the right rotor. This automated matching of left and right side pitch position is introduced as "synchronous-twin-pitch."

By adjusting the pitch position of the left rotor separately from the right rotor, problem areas in the concrete finishing job can be addressed. This is accomplished by changing the pitch position on the left rotor assembly but not the right. After addressing the problem area, the operator must adjust the pitch position of the left rotor assembly to match the pitch position of the right rotor assembly. With prior art trowels, the operator accomplished this through a sequence of first raising the right rotor to full pitch, and then adjusting the left to match; but this sequence can cause damage to the finish of the concrete without precise adjustment by the operator. The synchronous-twin-pitch function increases the accuracy at which pitch position of the left rotor assembly is synchronized to the present pitch position of the right rotor assembly, eliminating the need for an operator to manually adjust both the left and right rotor assemblies to their upper or lower stops, significantly decreasing the likelihood of damage to the concrete surface.

EMBODIMENTS OF PRESENT DISCLOSURE

Figure 1:
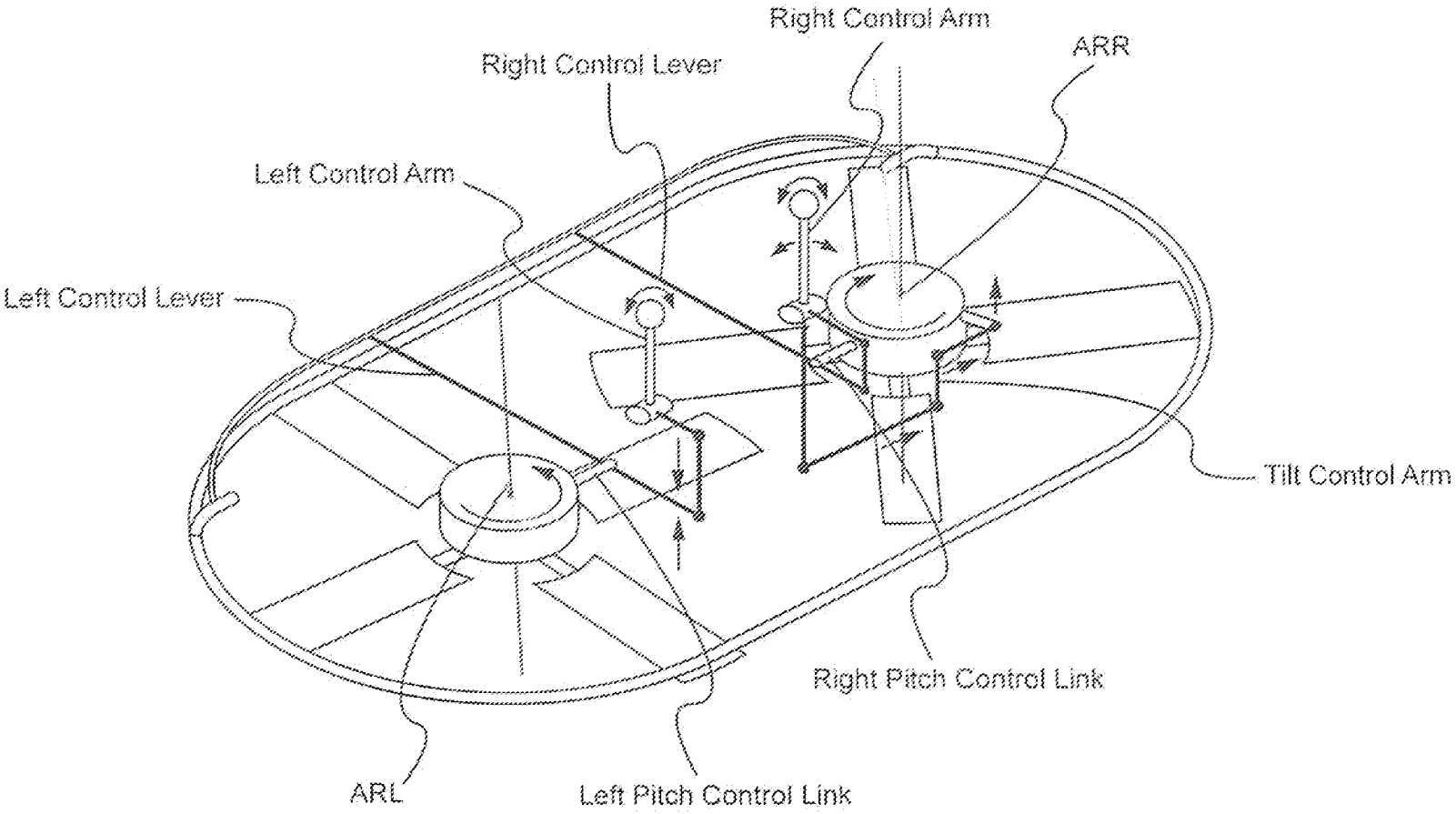
FIG. 1 is a prior art schematic representation of a mechanical control system of a two-rotor power trowel.
Figure 2:
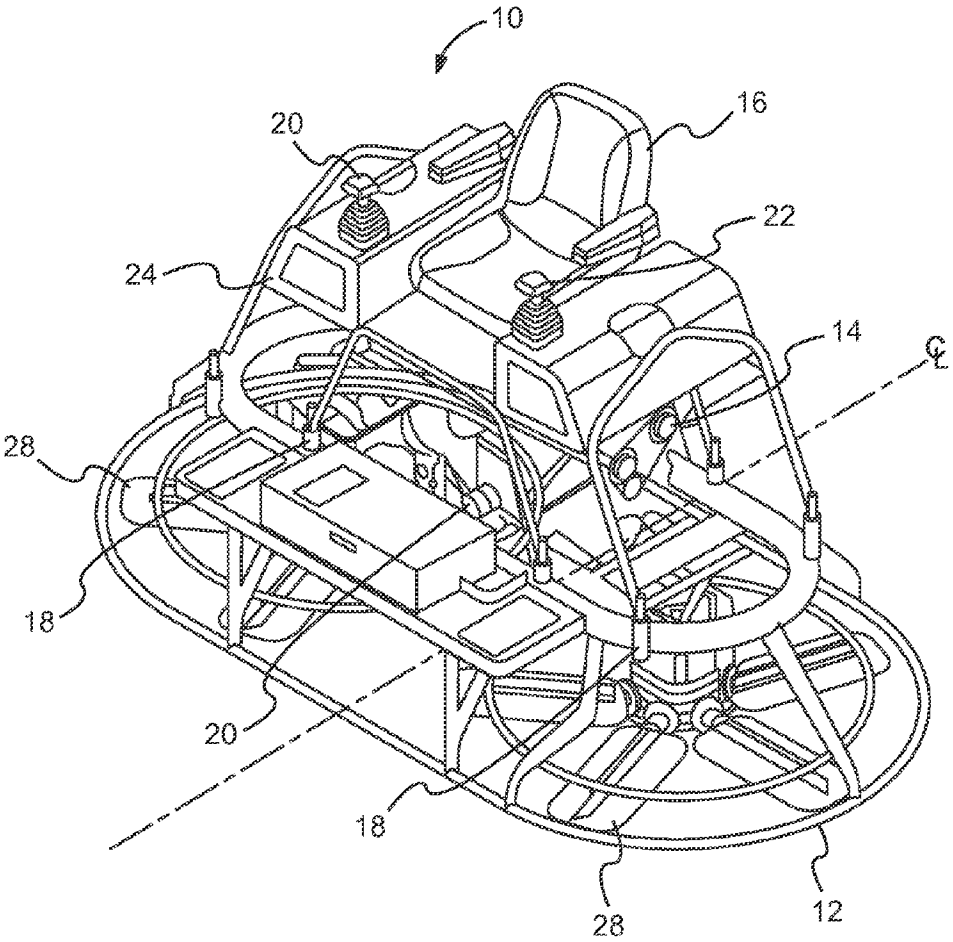
FIG. 2 is a perspective representational drawing of a hydraulically controlled riding power trowel with automated pitch control.
Figure 4:
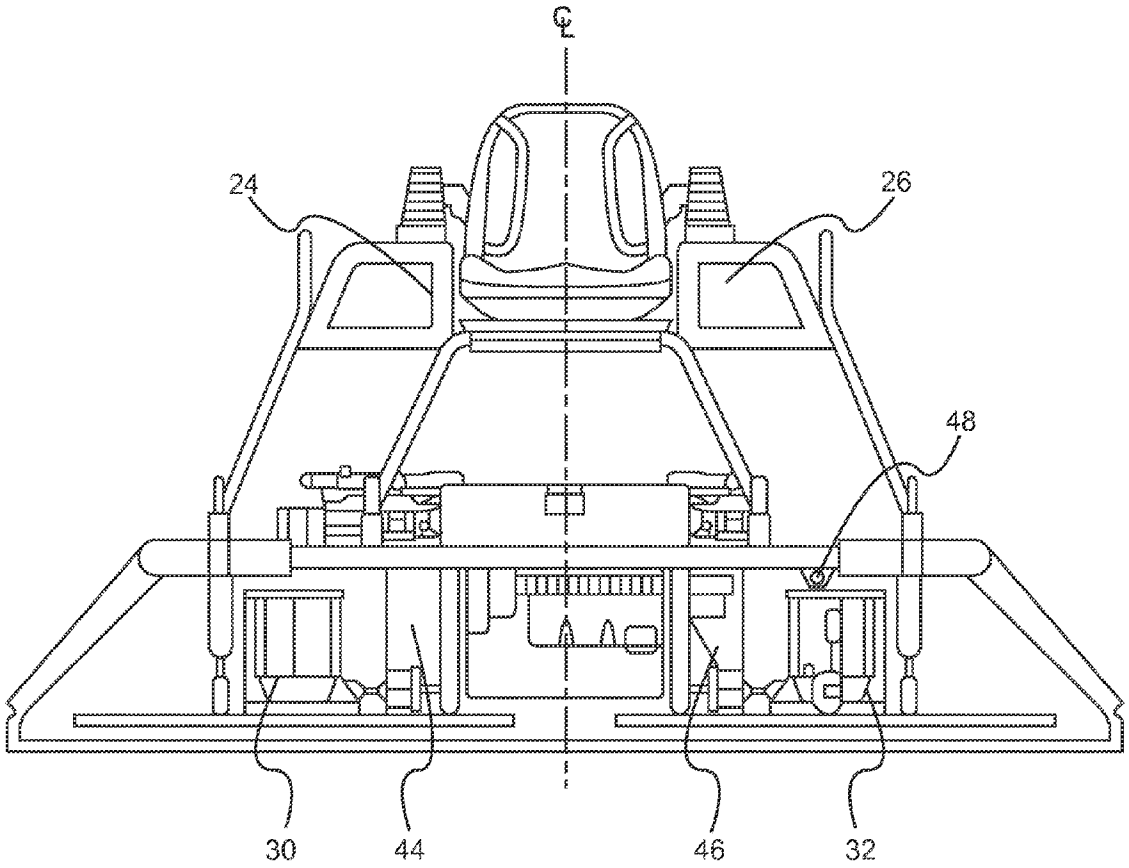
FIG. 4 is a sectional representational front view of a hydraulically controlled riding power trowel with automated pitch control.

FIG. 2 shows, in representational format, a hydraulically controlled riding power trowel 10 and its basic subassemblies, including frame 12, engine assembly 14, operator seat 16, and blade pitch and tilt control systems 18 for blades 28. Also included are left control lever 20 and right control lever 22, which operate, respectively, left control valve assembly 24, and right control valve assembly 26. As depicted in FIG. 4, left control valve assembly 24 is operable to tilt the left rotor assembly 30 in or out toward the center line of hydraulic steering control trowel 10. Right control valve assembly 26 is operably connected to the right rotor assembly 32 to provide a tilting movement—in or out from the center line—to right rotor assembly 32; and right control valve assembly 26 also provides for fore and aft tilting movement to the right rotor assembly 32. The rotary assemblies can be referred to as first rotary assembly 30 and second rotary assembly 32 or interchangeably may be referred to as left rotary assembly 30 and right rotary assembly 32. Right rotor assembly 32 is also fitted with right forward and aft cylinder 48, which tilts right rotor assembly 32 either fore or aft. If right rotor assembly 32 is tilted to apply pressure to the forward portion of the right rotor assembly 32, the machine will crab to the right. Conversely, if right rotor assembly 32 is tilted aft to apply pressure to the back of the rotor assembly, power trowel 10 will crab to the left.

Not shown in the drawings are the hydraulic pump, and the hydraulic hoses and fittings which interconnect both left and right control valve assemblies 24 and 26 to left and right tilting cylinders 44 and 46, as well as right pitch cylinder 48, all shown in FIG. 4. These portions of the hydraulic system are well known in the art; they play no part in the presently disclosed invention, as it is well known how to interconnect a hydraulic pump to the engine assembly 14, as well as how to interconnect the output of the hydraulic pump to dual action cylinders.

Figure 3A:
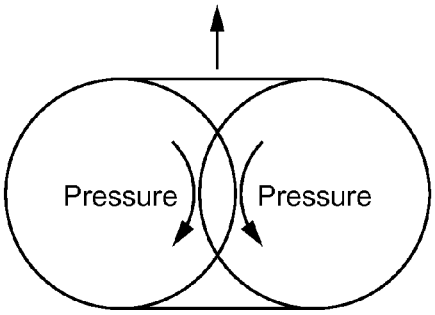
FIGS. 3A through 3F are diagrammatic indications of the different basic movements of the power trowel indicating the direction of rotation of rotors and the points at which increased downward pressure is applied by operation of the hydraulic steering control system.
Figure 3B:
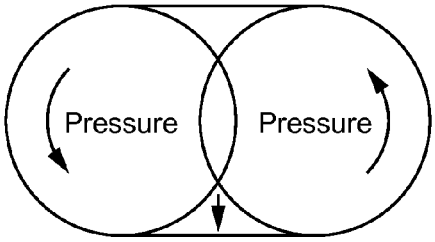
Figure 3C:
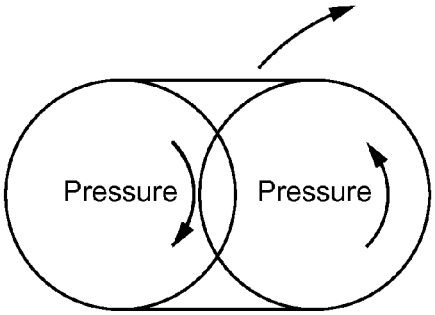
Figure 3D:
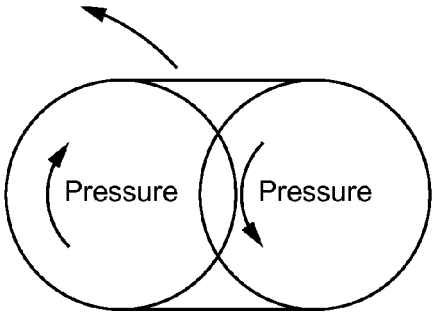
Figure 3E:
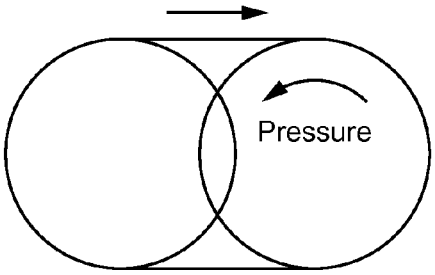
Figure 3F:
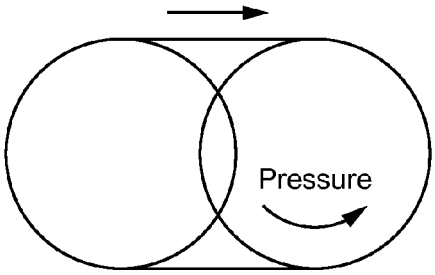

FIGS. 3A through 3D are diagrammatic indications of the different basic movements of power trowel 10, which can be achieved by tilting left rotor assembly 30 and right rotor assembly 32, either in or out from the centerline of power trowel 10. These basic movements are well known in the art. In FIG. 3A, if both rotors are tilted inward by right and left tilting cylinders 44 and 46 to apply increased pressure to rotor assemblies at the centerline of the power trowel 10, the resulting forces will move the power trowel in a forward direction. Likewise, if both rotors are tilted outward to apply increased pressure to the rotor assembly away from the centerline, then power trowel 10 will move in the reverse direction, as shown in FIG. 3B. In FIG. 3C, if pressure is applied to the right side of each of the rotors, it will cause the power trowel to swing to the right. Conversely, as shown in FIG. 3D, if pressure is applied to the left side of the rotors by tilting each to the left, then power trowel 10 will swing to the left.

Figure 5A:
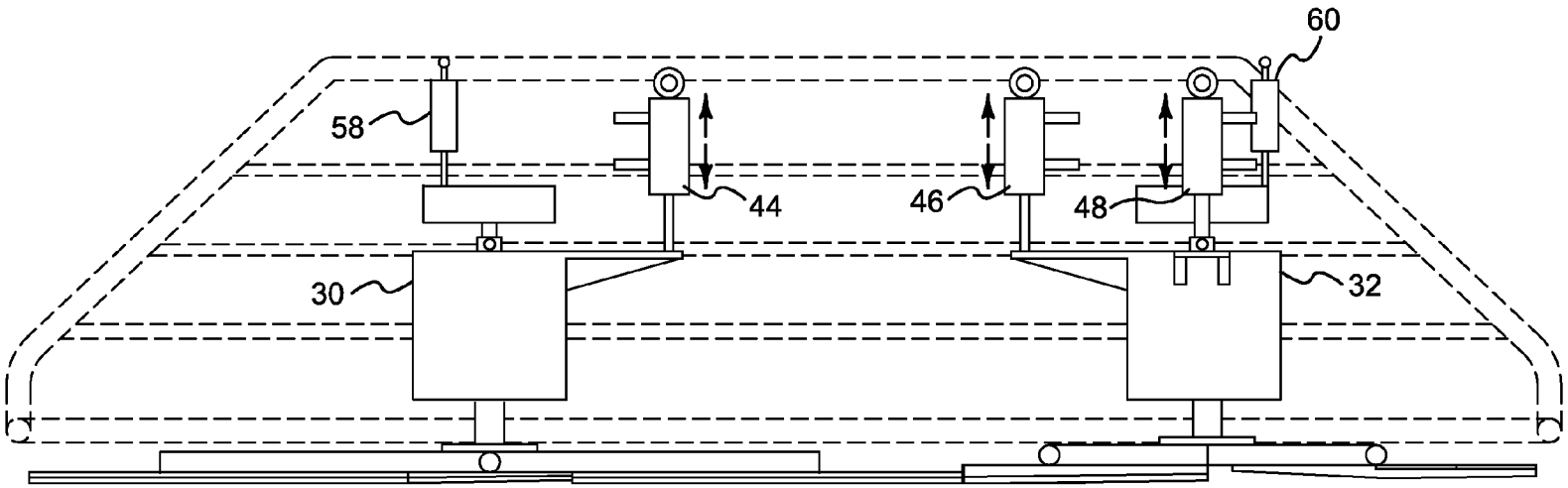
FIG. 5*a* is a sectional representational front view of one embodiment of rotor assemblies with the disclosed pitch control system.

Referring now to FIG. 5*a*, attached to each of the rotary assemblies 30 and 32 are pitch actuators 58 and 60, which change the pitch position of the blades on that rotary assembly. In one embodiment, the first pitch actuator 58 and second pitch actuator 60 can be dual action hydraulic smart cylinders or two hydraulic cylinders that cause the pitch adjusting links on the first and second rotary assembly to move and thereby change the pitch 64 (FIG. 6) of the troweling blades of the first and or second pitch assembly. Alternatively, the pitch actuators can be based on an electric motor—e.g., an electric motor that drives a screw, with the screw physically adjusting the pitch of the blades of the first or second rotary assembly, or both. It is also anticipated that the pitch actuators could be electric over hydraulic actuators, similar to a trailer brake system, whereby an electric control signal is sent to a hydraulic actuator, which causes pitch-adjusting links on the rotor assemblies to move.

Figure 5B:
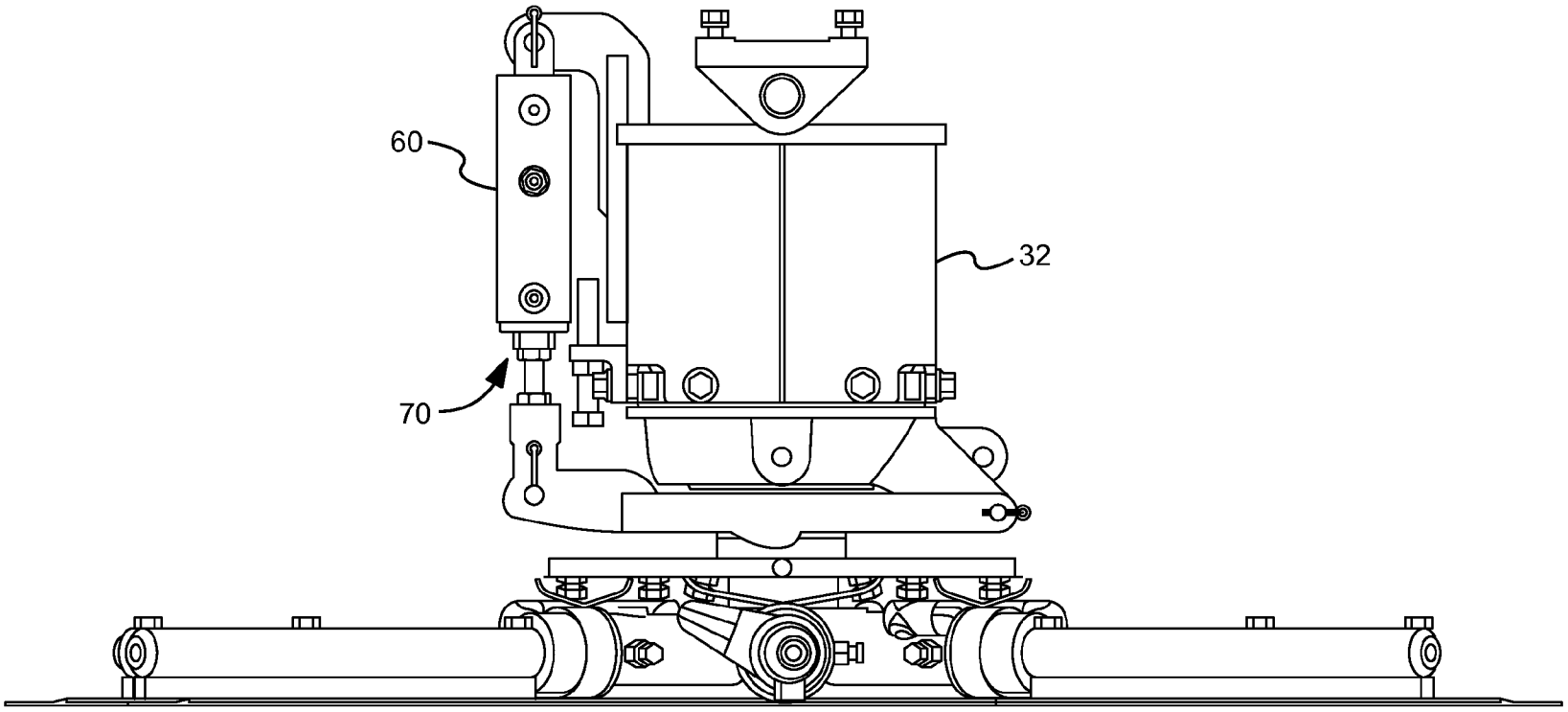
FIG. 5*b* is a sectional representational front view of one embodiment of one rotor assembly with the disclosed pitch control system.

In FIG. 5*b*, an alternative embodiment and presently the best mode known, attached to rotor assembly 30 is pitch actuator 60. FIG. 5*b* depicts a first rotor assembly, which could be duplicated in a trowel having a plurality of rotor assemblies employing this embodiment.

The disclosure also includes a first and second pitch position sensor. The pitch position sensor detects and reports the pitch position of at least one of the blades in each of the rotary assemblies. Pitch position 64 is the angle defined by a blade and a plane normal to the axis of rotation $A_R$ of rotary assemblies 30 and 32, as shown in and FIG. 6. The pitch position sensor can take a number of forms, with possibilities being a hydraulic cylinder that incorporates a linear position sensor. An example of such a device is a smart cylinder with a linear feedback resistance transducer with a 0.001-inch repeatability. Alternatively, the pitch position sensor could be mounted in each individual blade, or the pitch position sensor could be an optical device.

Figure 6:
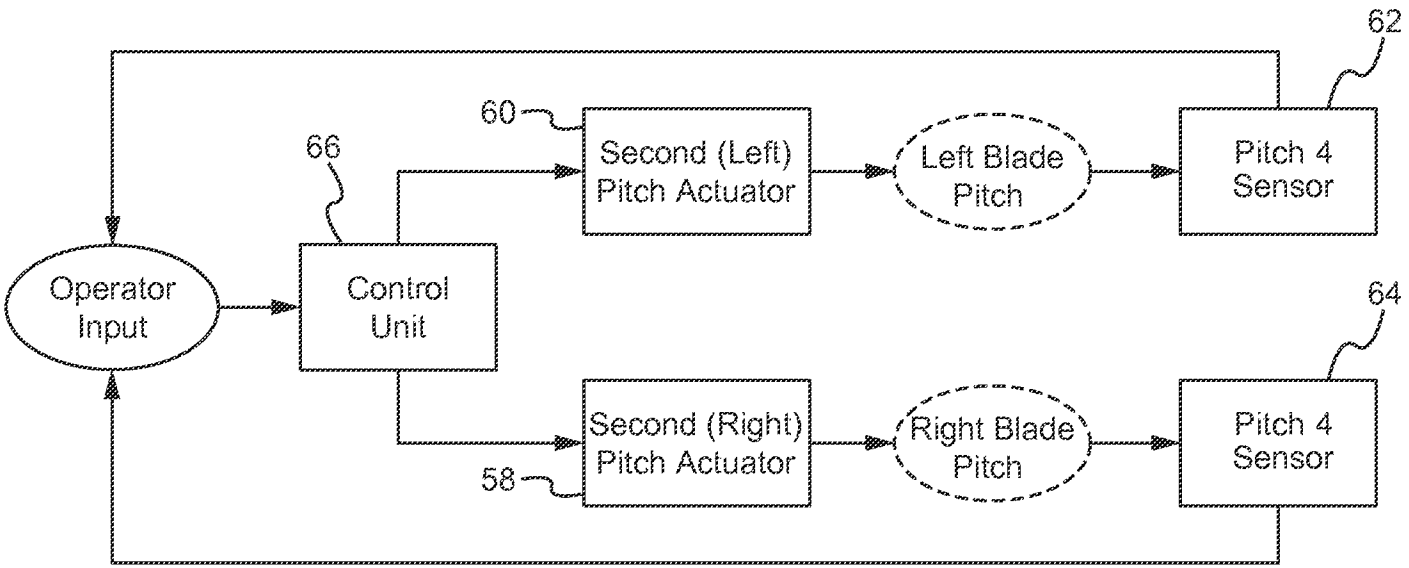
FIG. 6 is a diagram depicting the pitch control scheme.

The trowel and pitch position sensors 62 communicate with the control unit the pitch of each of the blades of each of the rotary assemblies, as shown in FIG. 6. In the preferred embodiment, a signal is sent from the pitch position sensor 62 to a control unit, in which the pitch position of the first and second rotary assemblies can be detected and compared. The control unit 66 then compares the input from the pitch position sensors 62 and signals the first pitch actuator 60 and second pitch actuator 62 to change as necessary the pitch position of the first and second respective rotor assemblies.

When the operator selects the manual mode, the pitch position of each rotor assembly can be adjusted independently or simultaneously, as described above. When the operator selects the "synchronous mode," and adjusts the pitch using the twin pitch switch, the synchronous-twin-pitch is enabled and the rotor assemblies automatically adjust to an identical pitch. In one embodiment of this disclosure, the control unit commands both the left and right pitch actuators simultaneously to maintain the same pitch on each rotor assembly throughout the movement. In an alternative embodiment, the control unit will command the first and second pitch actuators incrementally to maintain, though not instantly, the same pitch position on each rotor throughout the movement. Thus, in this seconded described embodiment, the control unit might adjust the first pitch position by two degrees. Then, the control unit will compare the pitch position of both rotor assemblies. It will then adjust the second pitch actuator to match the pitch position of the first assembly. Then, the control unit will again compare the pitch position of the two assemblies; and it will signal the pitch actuators to make incremental adjustments until the pitch of both assemblies is the same.

In one embodiment of the present disclosure, the control unit comprises a high-resolution, touch-screen, LCD display. It serves as the hardware portion of a graphical user interface for operator communication with the control unit. This display provides information to the operator in the form of graphs, pitch degrees, percentage of pitch, pump stroke, engine monitoring functions, operating hours, and time. The operator can control the pitch using buttons on the visual display or with the control buttons described above. The visual display depicts graphs that communicate the pitch position of each rotor assembly. The position is indicated as pitch degrees (or blade height) and percentage of full pitch (or percentage of full blade height). Further, the visual display visually communicates engine safety monitoring features, as well as information about the operating conditions of the trowel. The graphical user interface is menu-based, with submenus for data and control, including pitch calibration, throttle calibration, hours, language of display, engine error codes, and service and diagnostic information.

In one embodiment of the present disclosure, when the trowel is operated for power floating, rather than power troweling, the operator can manipulate a "pitch disengage switch" that disengages the rotor assemblies from the pitch actuators at linkages 70 and 72. The disengaged blades are held in a neutral state, in a flat or "zero pitch" position, such that the blades can move with the float pan without applying undesired pressure on the pan.

In another embodiment of the disclosure, the logic of the control unit provides that the operator can manipulate the twin pitch control switch in combination with the single pitch control switch to disengage the rotor assemblies from the pitch actuators. In this embodiment, the operator may likewise utilize a float pan with the trowel without applying undesired pressure on the pan.

We claim:

1. A self-propelled power trowel, for finishing a concrete surface, which comprises:

a rigid frame means adapted to be disposed over a surface, the rigid frame having a front and a rear and defining a centerline from front to rear;

an engine assembly for powering the power trowel supported by the rigid frame;

a pair of rotor assemblies for frictionally contacting the surface and supporting the rigid frame on the surface, tiltably connected to the rigid frame and operably connected to the engine, with each of the rotor assemblies having a plurality of individual troweling blades forming a troweling blade assembly with each individual troweling blade configured for adjustable pitch;

one or more steering actuators or mechanical linkages operably interconnected between the rigid frame and each of the rotor assemblies for tilting the rotor assembly fore and aft and left and right;

a first pitch actuator operably connected to a first rotor assembly, with the first pitch actuator configured to controllably change a pitch position of the individual troweling blades of the first rotor assembly;

a second pitch actuator operably connected to a second rotor assembly, with the second pitch actuator configured to controllably change a pitch position of the individual troweling blades of the second rotor assembly;

a first troweling blade pitch position sensor for detecting and reporting a pitch position of at least one of the troweling blades of the first rotor assembly;

a second troweling blade pitch-position sensor for detecting and reporting a pitch position of at least one of the troweling blades of the second rotor assembly; and a control unit for receiving a pitch position signal from each of the first and second troweling blade pitch position sensors, and controlling, via the first and second pitch actuators, the pitch position of the first and second troweling blades of the first and second rotor assemblies with control logic that provides for either a synchronous pitch mode or a manual pitch mode and the ability for a trowel operator selectively switch from one to other the pitch modes.

2. The self-propelled power trowel of claim 1 that further comprises a first pitch actuator comprised of a hydraulic cylinder pitch actuator attached to the rigid frame and configured to control the pitch position of the individual troweling blades of the first rotor assembly, and a second pitch actuator comprised of a hydraulic cylinder pitch actuator attached to the rigid frame and configured to control the pitch position of the individual troweling blades of the second rotor assembly.

3. The self-propelled power trowel of claim 1 that further comprises a first and second pitch actuator each comprised of an electric motor pitch actuator attached to the rigid frame and configured to control the pitch position of the rotor assemblies.

4. The self-propelled power trowel of claim 3 that further comprises a first and second pitch actuator each comprised of an electric-over-hydraulic actuator attached to the rigid frame and configured to control the pitch position of the rotor assemblies.

5. A self-propelled power trowel, for finishing a concrete surface, which comprises:

a rigid frame means adapted to be disposed over the concrete surface, the rigid frame having a front and a rear and defining a centerline from front to rear;

an engine means for powering the power trowel supported by the rigid frame;

a pair of rotor assemblies for frictionally contacting the concrete surface and supporting the rigid frame on the concrete surface, tiltably connected to the rigid frame and operably connected to the engine, with each of the rotor assemblies having a plurality of individual troweling blade forming a troweling blade assembly with each individual troweling blade configured for adjustable pitch;

one or more steering actuators or mechanical linkages operably interconnected between the rigid frame and each of said rotor assemblies for tilting said rotor assembly fore and aft and left and right;

a first pitch actuator operably connected to a first rotor assembly, with the first pitch actuator configured to controllably change a pitch position of the individual troweling blades of the first rotor assembly;

a second pitch actuator operably connected to a second rotor assembly, with the second pitch actuator configured to controllably change a pitch of the individual troweling blades of the second rotor assembly;

a first troweling blade pitch-position sensor for detecting and reporting a pitch position of at least one of the troweling blades of the first rotor assembly;

a second troweling blade pitch position sensor for detecting and reporting a pitch position of at least one of the troweling blades of the second rotor assembly; and a control unit for receiving reporting from troweling blade pitch position sensors and for communicating with and controlling the pitch actuators.

6. The self-propelled power trowel of claim 5 that further comprises pitch actuators comprised of hydraulic cylinder pitch actuators and linear position sensors in each of the pitch actuators.

7. The self-propelled power trowel of claim 5 that further comprises a first and second pitch actuator each comprised of an electric motor pitch actuator attached to the rigid frame and configured to control the pitch position of the rotor assemblies.

8. The self-propelled power trowel of claim 5 that further comprises a troweling blade pitch position sensor comprised of a position sensor in an electric motor assembly.

9. The self-propelled power trowel of claim 5 that further comprises a first and second pitch actuator each comprised of an electric-over-hydraulic actuator attached to the rigid frame and configured to control the pitch position of the rotor assemblies.

10. The self-propelled power trowel of claim 5 in which the troweling blade pitch position sensor comprises an optical beam configured to encounter the troweling blades to sense troweling blade pitch position.

11. The self-propelled power trowel of claim 5 in which the troweling blade pitch position sensor is a device mounted on one or more troweling blades of each of the rotor assemblies.

12. The self-propelled power trowel of claim 5 that further comprises a single pitch control switch for adjusting the first rotor assembly pitch position independently from the second rotor assembly pitch position.

13. The self-propelled power trowel of claim 5 that further comprises a twin pitch control switch for adjusting the troweling blade pitch position of both the first and second rotor assemblies simultaneously.

14. The self-propelled power trowel of claim 5 that further comprises a manual pitch mode and synchronous pitch mode with control logic that provides for manual or synchronous-twin-pitch control of the first and second rotor assemblies.

15. The self-propelled power trowel of claim 5 that further comprises a pitch disengage switch for disengaging the rotor assemblies from the respective pitch actuators to allow the blades of each rotor assembly to float at zero pitch.

16. The self-propelled power trowel of claim 5 that further comprises a twin pitch control switch and single pitch control switch used in combination for disengaging the pitch adjuster from the troweling blade pitch angle of both the first and second rotor assemblies allowing them to float at zero pitch.

17. A self-propelled power trowel, for finishing a concrete surface, which comprises:

a rigid frame means adapted to be disposed over a surface, the rigid frame having a front and a rear and defining a centerline from front to rear;

an engine assembly for powering the power trowel supported by the rigid frame;

a pair of rotor assemblies for frictionally contacting the surface and supporting the rigid frame on the surface, tiltably connected to the rigid frame and operably connected to the engine, with each of the rotor assemblies having a plurality of individual troweling blades forming a troweling blade assembly with each individual troweling blade configured for adjustable pitch;

one or more actuators or mechanical linkages operably interconnected between the rigid frame and each of the rotor assemblies for tilting the rotor assembly fore and aft and left and right;

a first pitch actuator operably connected to a first rotor assembly, with the first pitch actuator configured to controllably change a pitch of the individual troweling blades of the first rotor assembly;

a second pitch actuator operably connected to a second rotor assembly, with the second pitch actuator configured to controllably change a pitch of the individual troweling blades of the second rotor assembly;

a single pitch control switch for adjusting the first rotor assembly pitch position independently from the second rotor assembly pitch position;

a twin pitch control switch for adjusting the troweling blade pitch position of both the first and second rotor assemblies simultaneously;

a manual pitch mode and synchronous pitch mode with control logic that provides for manual or synchronous-twin-pitch control of the first and second rotor assemblies; and a pitch disengage switch for disengaging the rotor assemblies from the respective pitch actuators for allowing the blades of each rotor assembly to float at zero pitch.

18. The self-propelled power trowel of claim 17 with an touch-screen interface from operator communication with the control unit.

* * * * *